US006828529B1

(12) United States Patent
Wu

(10) Patent No.: US 6,828,529 B1
(45) Date of Patent: Dec. 7, 2004

(54) INTEGRATED FORM OF COOLING FIN IN HEATING BODY

(76) Inventor: Chia-Hsiung Wu, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/463,661

(22) Filed: Jun. 18, 2003

(51) Int. Cl.[7] ..... H05B 3/06
(52) U.S. Cl. ..... 219/540; 219/202
(58) Field of Search ..... 257/718, 720, 257/739, E23.084; 165/80.2, 185; 174/16.3; 219/505, 530, 540, 541, 202; 392/485, 502; 156/252, 273.7, 273.9, 274.8, 275.5, 295, 307.3

(56) References Cited

U.S. PATENT DOCUMENTS 4,151,547 A * 4/1979 Rhoades et al. ..... 174/16.3
4,414,052 A * 11/1983 Habata et al. ..... 156/273.7
4,899,032 A * 2/1990 Schwarzl et al. ..... 219/540
6,259,075 B1 * 7/2001 Wu ..... 219/540

* cited by examiner

*Primary Examiner*—Tu Hoang
(74) *Attorney, Agent, or Firm*—Troxell Law Office PLLC

(57) ABSTRACT

An integrated form of a cooling fin in a heating body, and more particularly, to an integrated form applied for joining a ceramic heating element and a cooling fin. Three-dimensionally expanded adhering areas are formed at relative joining planes of the wave-like cooling fin and the ceramic heating element, thereby increasing an adhering interface thereof and providing spaces for accumulating the adhesive, and further accomplishing reinforced binding forces and buffer purposes.

7 Claims, 6 Drawing Sheets

INTEGRATED FORM OF COOLING FIN IN HEATING BODY

BACKGROUND OF THE INVENTION (a) Field of the Invention

The invention relates to an integrated form of a cooling fin in a heating body, and more particularly, to an integrated form applied for joining a cooling fin to a surface of a heating element that is formed by a ceramic resistor having positive temperature coefficients. The invention is especially suitable for applications in automobiles, or other heating bodies used in equipments having vibrating energy, so as to securely fasten the heating element and the cooling fin while also obtaining shock-absorbing effects and preventing dismantling of elements.

(b) Description of the Prior Art

Heating apparatus using ceramic resistors as heating members thereof, due to characteristics of the ceramic resistors as being temperature constant and having rapid heating speed without causing flint, are extensively used in heat wave producing applications in various transportation equipments or instruments, and household warming systems. In a prior heating body, a heating element and a cooling fin thereof are joined using mechanical press bonding and agglutination. Referring to FIG. 1, a heating element 1 has an electrode layer 11 at two sides thereof, respectively. Each of the electrode layers 11 is pressed against and conducted by the cooling fins 2, so as to conduct electricity and transmit heat waves. The cooling fins 2 applied with the electrode layer 11 are stabilized by a supporting plank 3 via an externally adjacent insulation layer 41. Through tension provided by a spring 4 between the supporting plank 3 and an outer frame 5, the cooling fins 2 are bi-directionally pressed against the two sides of the ceramic heating element 1. However, when the prior heating body formed using elastic press bonding is applied in an automobile, the heating element 1 and the cooling fins 2 are prone to be relative displaced owing to vibration energy of a traveling automobile or being located at a point of mechanical resonance.

There is a more advanced heating body formed by agglutination available on the market. Referring to FIG. 2, a heating element 1 is applied with a conductive layer 11. The conductive layer 11 is faced with wave bases of a cooling fin 2 formed in a sine wave structure, and is adhered by adhesive 6, such that the wave bases are in contact with a surface of the electrode layer 11 for conducting electricity and providing shortest heat transmission paths. Yet, the surface of the cooling fin 2 is a smooth surface, and an adhered plane thereof still forms a smooth plane having insufficient structural strength after being adhered by the adhesive 6. As a result, loosening and dismantling are similarly incurred accompanied with acceptance of vibration energy.

Again, a heating body having reinforced strength had become available. Referring to FIG. 3, an underside of a cooling fin 2 is plated with a tin layer 7. The tin layer 7 is made of a material that may be fused as a material of the electrode layer 11 of the ceramic heating element 1. It is to be noted that the heating element 1 has intrinsic mass and the tin layer 7 is a hard substance. As a result, when a heating body formed using the aforesaid method is applied in vibrating equipments such as automobiles, in which considerable energy formed while reaching a point of mechanical resonance is acted upon a joining plane thereof, interface substances between the tin layer 7 and the electrode layer 11 are likely to become crisp. In addition, stress generated from receiving vibrating energy is concentrated, so that the entire electrode layer 11 gets peeled off from receiving the stress, and the heating element 1 becomes exposed as shown in the diagram. Also, manufacturing process using the aforesaid method is rather complicated and inconvenient that production costs are relatively increased. Above all, during the peeling off process, short circuits and sparks are likely caused for that various materials used are all conductive.

SUMMARY OF THE INVENTION

In the view of the aforesaid shortcomings, the primary object of the invention is to provide an integrated form of a cooling fin in a heating body, and that the integrated form is capable of providing reliable joining strength. Wherein, elasticity of the aforesaid adhesive 6 is capable of absorbing vibrating energy, and three-dimensionally expanded adhering areas are formed at a joining plane of the aforesaid cooling fin 2. The three-dimensional spaces formed are for containing the adhesive, and larger ranges are provided for absorbing vibrating energy through elasticity of molecules of the adhesive 6, thereby ensuring joining and binding of various elements.

DETAILED DESCRIPTION OF THE PREFERRED EMBODIMENTS

To better understand the invention, detailed descriptions shall be given with the accompanying drawings hereunder.

Figure 1:
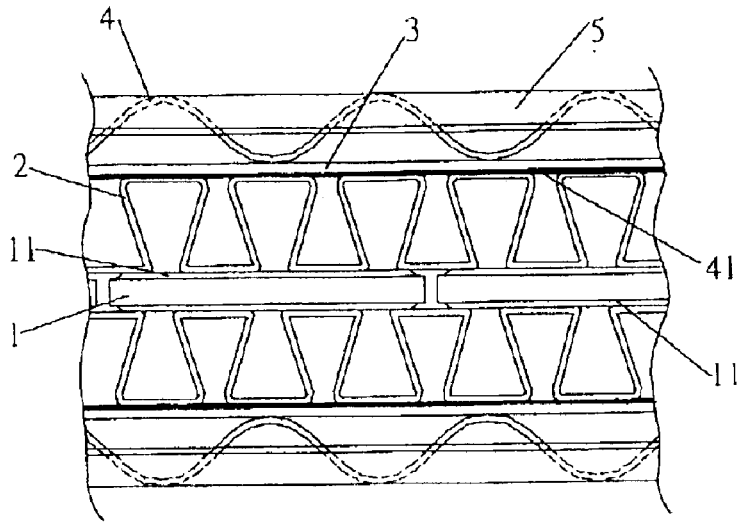
FIG.1 Prior Art
FIG. 1 shows a conventional schematic view of prior cooling fins assembled by mechanical means.
Figure 2:
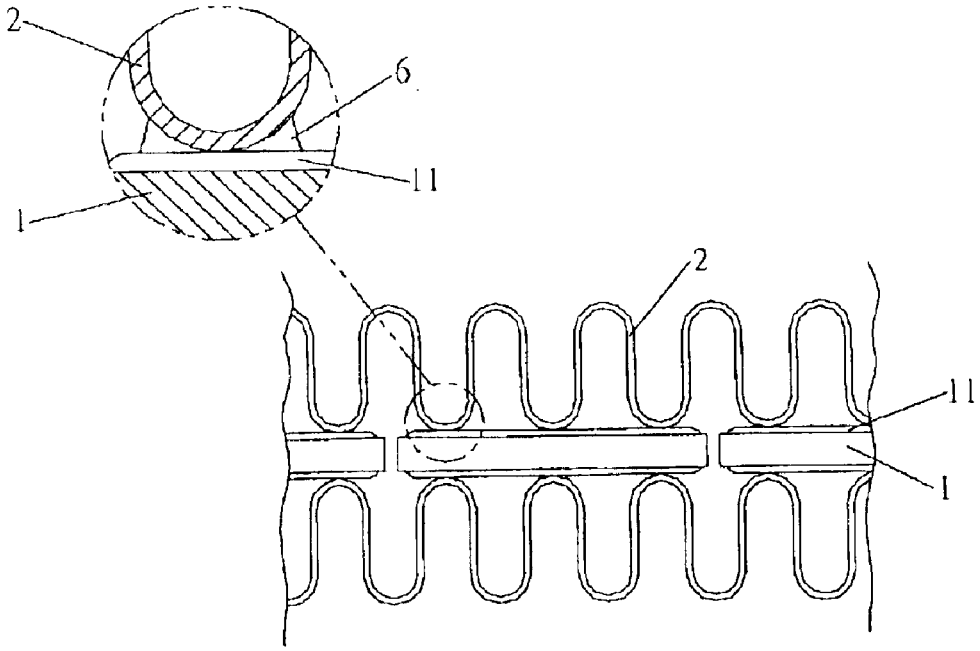
FIG.2 Prior Art
FIG. 2 shows a conventional schematic view of prior cooling fins joined using adhesive.
Figure 3:
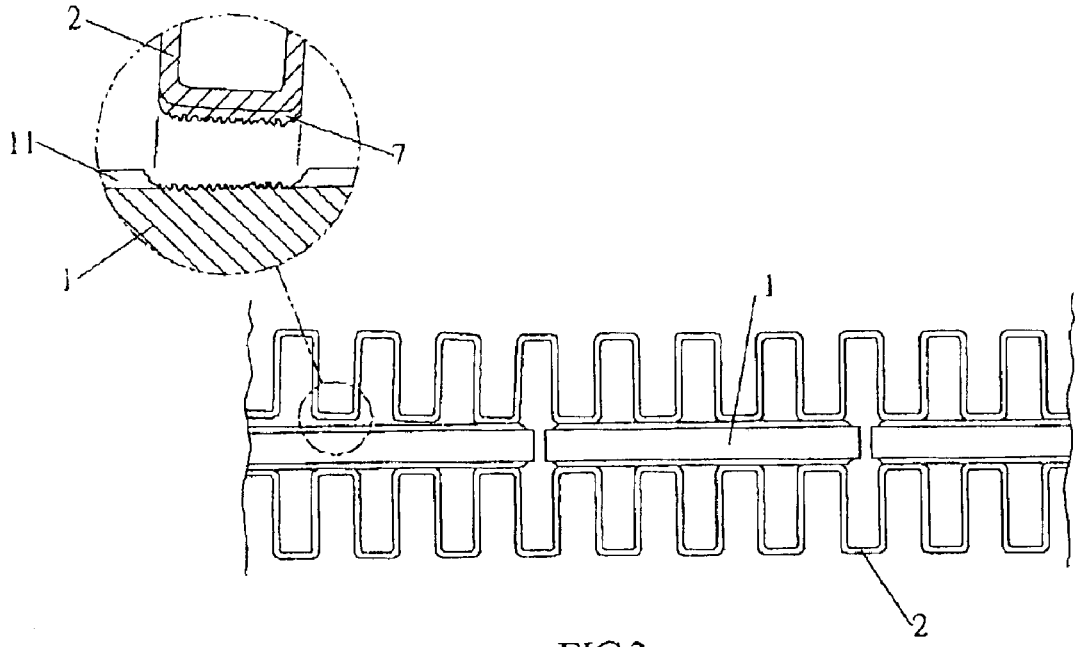
FIG.3 Prior Art
FIG. 3 shows a conventional schematic view of prior cooling fins joined by soldering.
Figure 4:
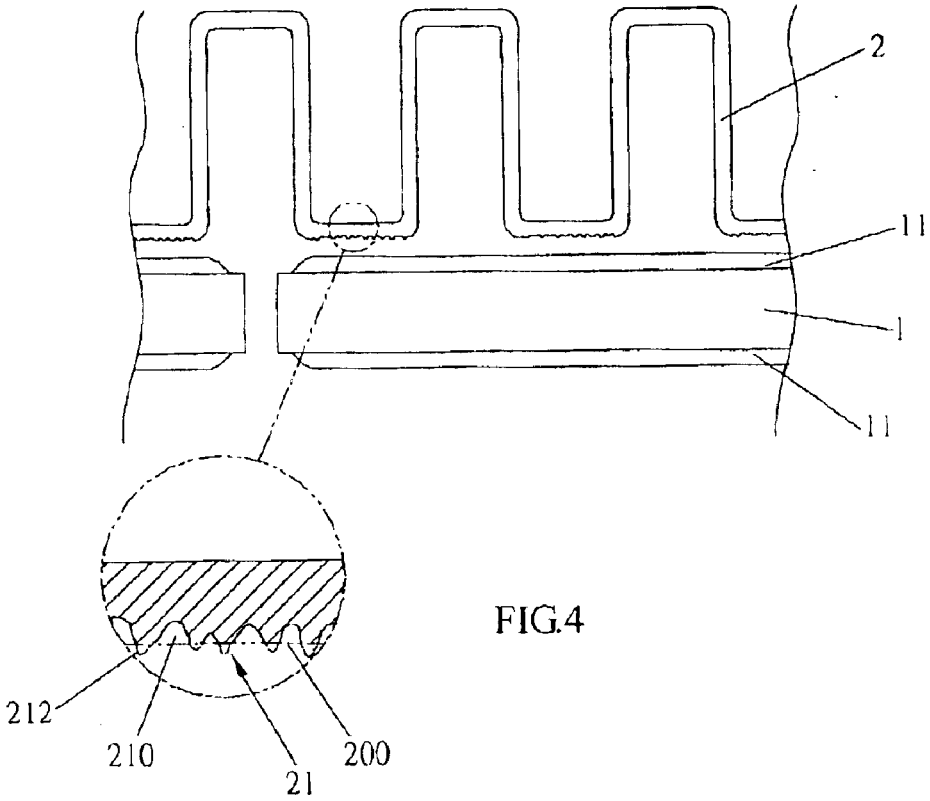
FIG. 4 shows a schematic view of a joining plane formed with indentures according to the invention.

Referring to FIG. 4, a surface of a ceramic heating element 1 is similarly applied with an electrode layer 11. An underside of a cooling fin 2 is disposed with a joining plane 21, so as to form an irregular and uneven surface having irregular indentures 210 using three-dimensional processing. Through the indentures 210, the joining plane 21 is provided with larger three-dimensional geometric areas for adherence.

Figure 5:
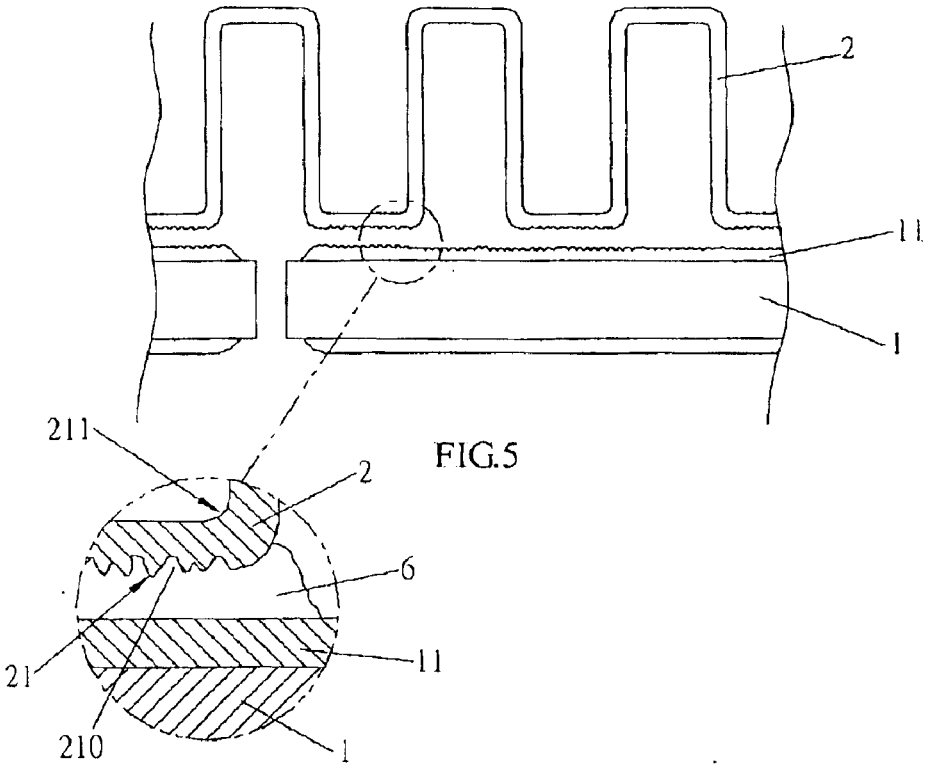
FIG. 5 shows a schematic view illustrating adhering process of an embodiment according to the invention.

Referring to FIG. 5 showing joining process according to the invention, adhesive 6 is applied to relative surfaces of the joining plane of the cooling fin 2 and the electrode layer 11 of the ceramic 1, such that the adhesive 6 is spread and filled following positions of the indentures 210. It is apparent from a curve that adhering areas of the joining plane 21 are multiplied into three-dimensional geometric areas. Portions of the cooling fin 2 protruding downward are directly in contact with the surface of the electrode layer 11, thereby conducting electricity and transmitting heat. Furthermore, inclined cone-shaped adhesive 6 is also accumulated at positions of tips 211 for providing extra assistant adhesive forces having inclined angles. Amounts of physical bodies of the adhesive 6 are increased due to not only expansion of the adhering areas of the joining area 21, but also accumulation of the adhesive 6 into the indentures 210. Besides, for that the adhesive 6 is consisted of macro-molecular substances, binding forces between the molecules thereof are utilized for achieving elasticity, and vibration energy is therefore absorbed by comparatively larger areas as well.

The adhesive 6 may also be replaced by adhesive capable of heat transmission and electric conductivity for similarly obtaining good heat transmission and electric conductivity effects.

The indentures 210 may be disposed in a regular arrangement by patterning using machines for similarly enlarging adhering areas.

Figure 6:
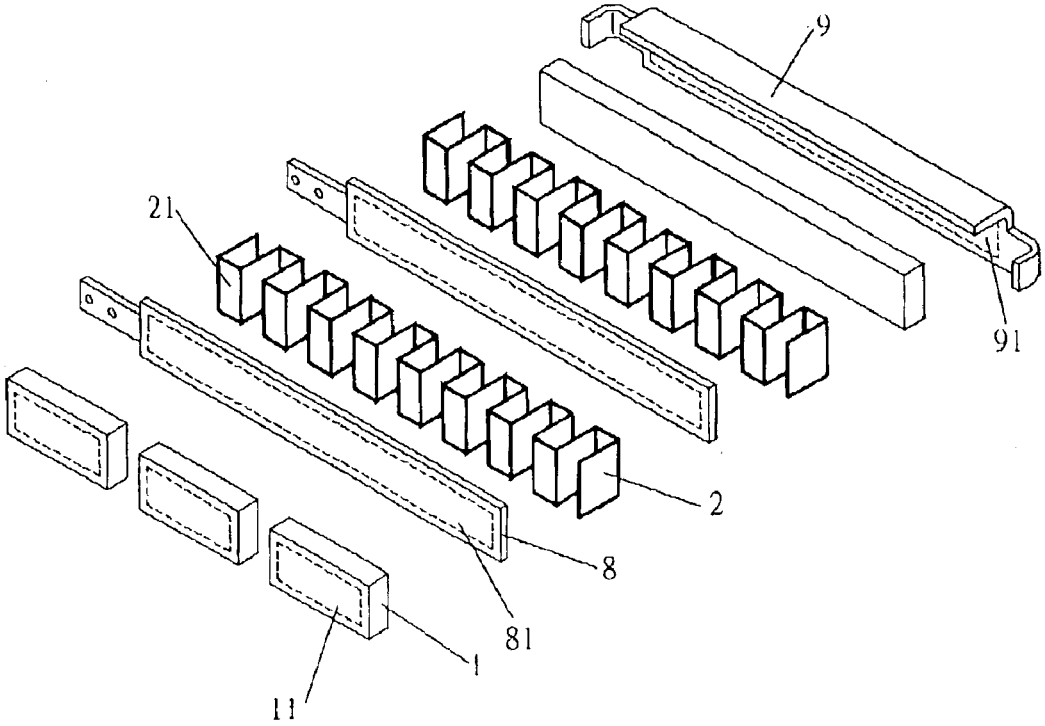
FIG. 6 shows an elevational schematic view of other additional elements according to the invention.

Referring to FIG. 6, apart from forming at the heating element 1 and relative adhering portions of the cooling fin 2, the aforesaid three-dimensional coarse plane is also applied for forming related elements of the heating body such as conducting planes 81 and pressing planes 91 of attached electrode plates 8 and side frames 9 at outer peripheries of the electrode plates 91. Internals of the relative joining planes may be processed for expanding the uneven adhering areas, thereby providing shock absorbent and adhering effects after being joined using adhesive.

Figure 7:
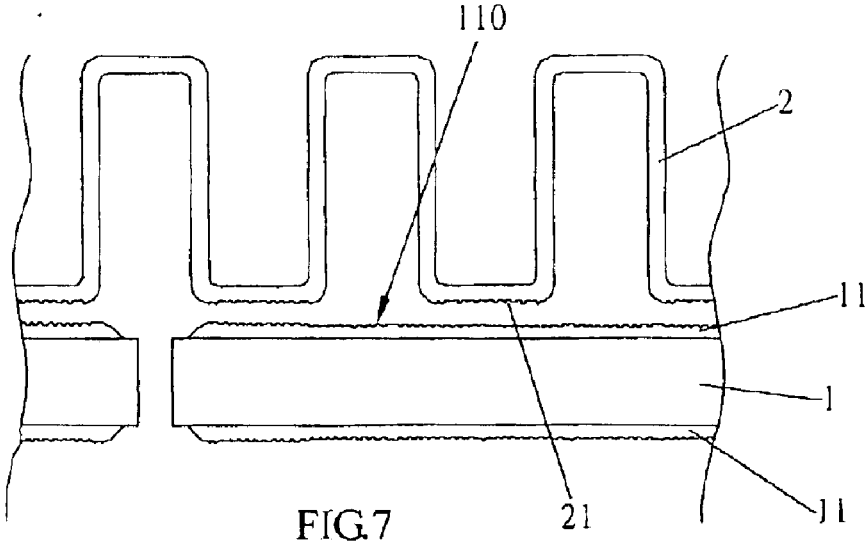
FIG. 7 shows a first embodiment according to the invention.

Referring to FIG. 7, besides expanding the adhering areas of the joining plane 21 of the cooling fin 2, similar indentures 110 may also be formed at a surface of the electrode layer 11 of the ceramic heating element 1. Using the three-dimensionally expanded adhering areas of both the joining plane 21 and the electrode layer 11, adhesive forces of the adhesive 6 are bi-directionally doubled and accumulated mass of the adhesive 6 is also increased, thereby substantially elevating mechanical performances thereof.

Moreover, to increase contact evenness at breadths of joining planes of various elements, or to increase effective and controllable contact points, lumpy sharp angles 212 formed as shown in FIG. 4 are pared so as to obtain an even benchmarking joining plane 200 for effectively controlling joining planes of the various elements as well as controlling assembled sizes of the various within acceptable accuracy ranges. For instance, most of the plurality of sharp angles 212 has distinct heights after being formed, and if accuracy requirement for assembly is calculated on micron basis, it then necessary to acquire a line of processing position and to pare the sharp angles 212 exceeding the predetermined height. After processing, top surfaces of the angles are leveled so as to form a foundation plane for the joining to other planes while maintaining the indentures 210 at indented portions.

Figure 8:
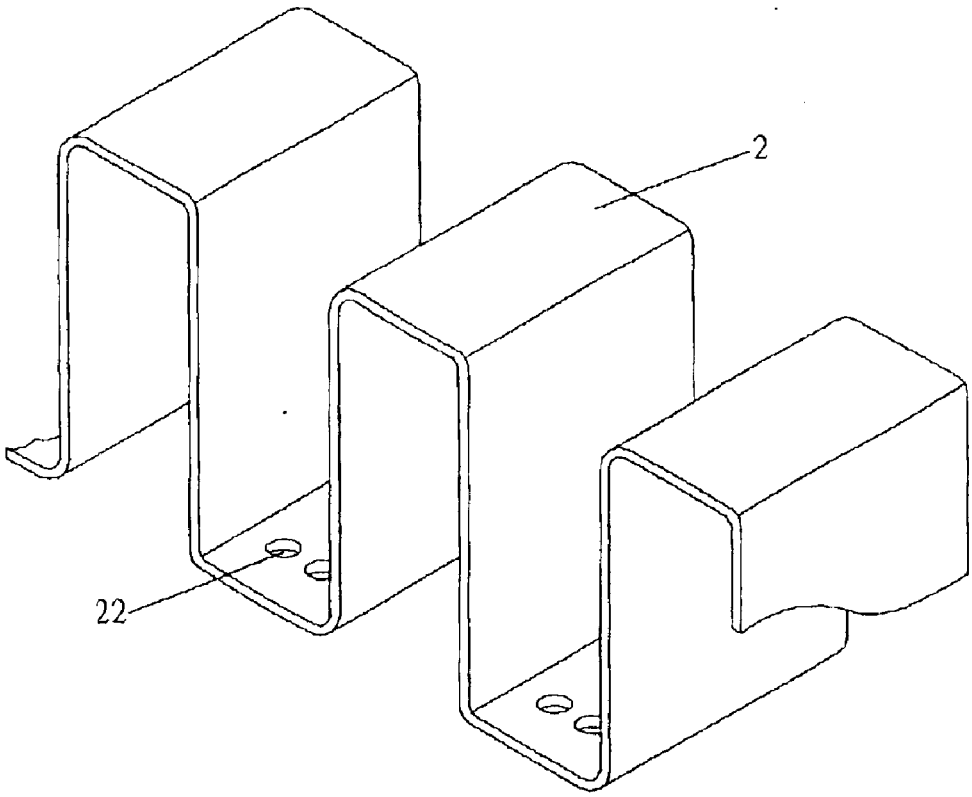
FIG. 8 shows a second embodiment according to the invention.
Figure 9:
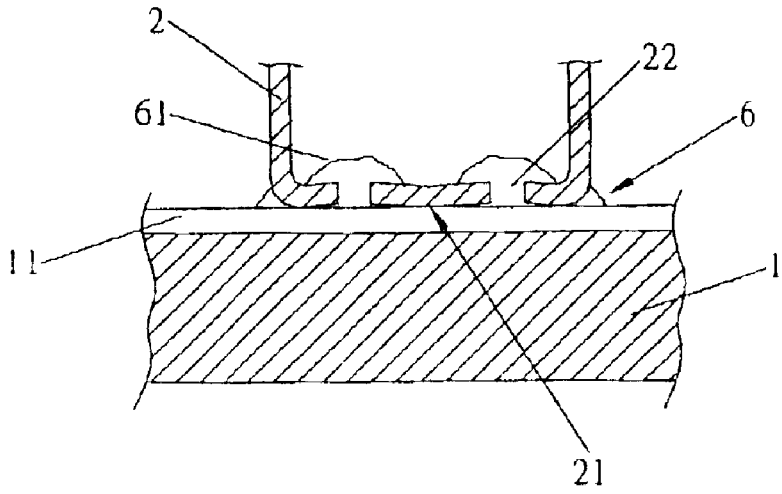
FIG. 9 shows a side view of FIG. 7 being adhered according to the invention.

Referring to FIGS. 8 and 9 showing other embodiments having effective adhering method according to the invention, holes 22 are formed at the joining plane of the cooling fin 2 by punching. When the electrode layer 11 of the heating element 1 is adhered to the cooling fin 1 using the adhesive 6, the adhesive 6 is exuded through the holes 22 owing to circulating property thereof to further form protruding bumps 61. The bumps 61 are capable of successfully fastening the cooling fin 2 in a reverse direction, and the joining plane 21 of the cooling fin 2 is similarly adhered to the heating element 1 using the adhesive 6.

Figure 10:
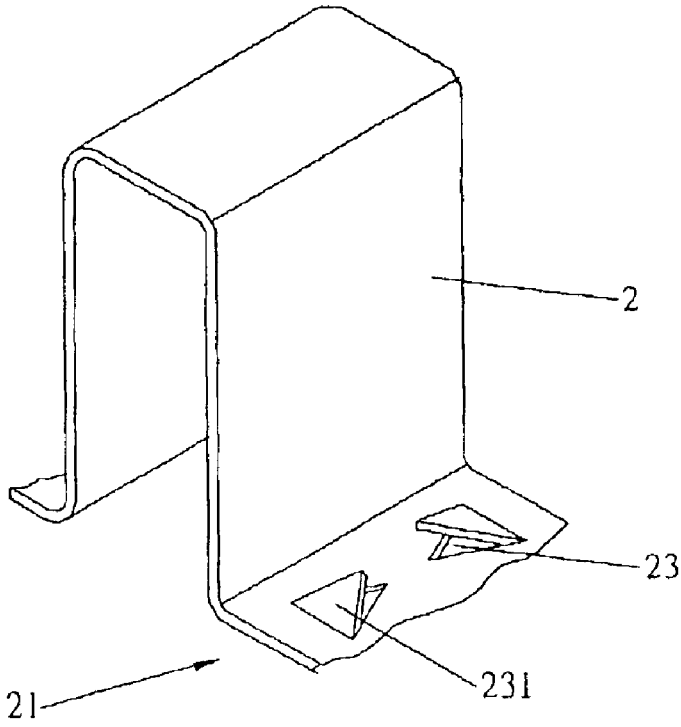
FIG. 10 shows a third embodiment according to the invention.

Referring to FIG. 10, in addition to provision of the aforesaid holes 22, windows 23 having any shapes are formed at the joining plane 21 by cutting. One side of each window 23 is reserved for forming a tongue piece 231, such that the adhesive 6 is similarly exuded out of the windows 23 to further forming reverse fastening forces similar to those shown in FIG. 8. Also, surplus adhesive is relatively adhered to the tongue pieces 231 for increasing multi-directional binding forces.

Figure 11:
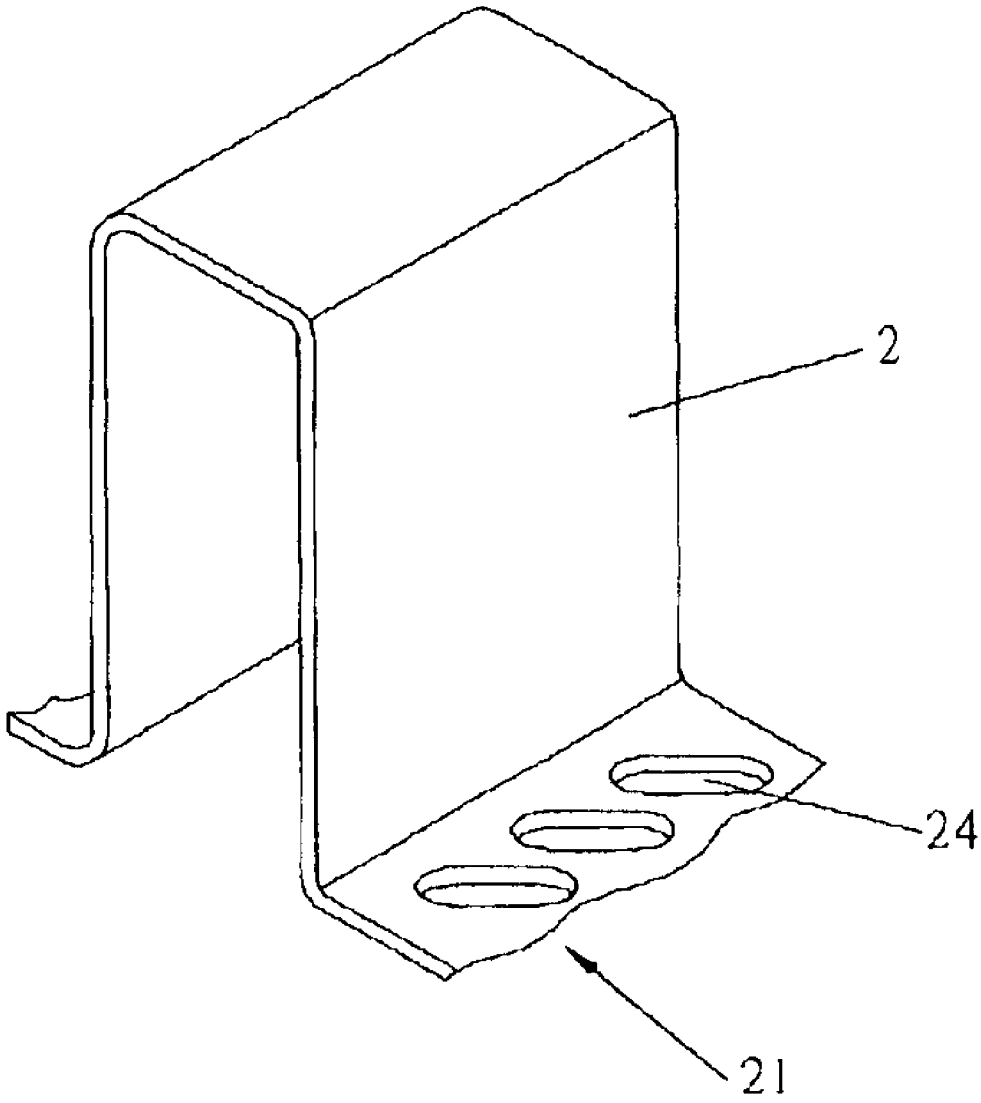
FIG. 11 shows a fourth embodiment according to the invention.

Referring to FIG. 11, according to method of forming holes of the invention, the joining plane 21 of the cooling fin 2 is disposed with a plurality of grooves 24 by slotting. The exuded adhesive 6 is also capable of reversely fastening the grooves 24. In the presence of the grooves 24, larger spaces are formed for accumulating adhesive, and larger solidification areas are relatively provided for the adhesive 6, thereby obtaining another method for effectively fastening the cooling fin 2.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An integrated structure of a cooling fin and a heating body comprising:

a) a cooling fin having a mounting form on a bottom thereof, the mounting surface having an irregular in uneven surface;

b) a ceramic resistor having positive temperature coefficients;

c) an electrode layer located on an outer surface of the ceramic resistor; and d) an adhesive connecting the mounting surface of the cooling fin and the electrode layer, the adhesive filling the irregular and uneven surface of the cooling fin.

2. The integrated form of a cooling fin in a heating body in accordance with claim 1, wherein the electrode layer disposed at the ceramic resistor is also three-dimensionally formed with uneven surfaces for expanding adhering areas.

3. The integrated form of a cooling fin in a heating body in accordance with claim 1, wherein elements for forming the electrode later or a side frame, a conducting plane or a pressing plane thereof is further processed and formed with uneven surfaces capable of enlarging adhering effects.

4. The integrated form of a cooling fin in a heating body in accordance with claim 1, wherein angles formed at the uneven surface are processed and pared to a predetermined benchmarking line, thereby forming an even benchmarking joining plane.

5. The integrated form of a cooling fin in a heating body in accordance with claim 1, wherein holes are provided at the mounting surface of the cooling fin by punching.

6. The integrated form of a cooling fin in a heating body in accordance with claim 1, wherein windows are provided at the mounting surface of the cooling fin by cutting, and one side of each window is reserved with a tongue piece.

7. The integrated form of a cooling fin in a heating body in accordance with claim 1, wherein grooves are provided at the mounting surface of the cooling fin.

* * * * *